US012543793B2

(12) United States Patent
Lee et al.

(10) Patent No.: US 12,543,793 B2
(45) Date of Patent: Feb. 10, 2026

(54) AEROSOL GENERATING DEVICE AND AEROSOL GENERATING SYSTEM

(71) Applicant: KT&G CORPORATION, Daejeon (KR)

(72) Inventors: Wonkyeong Lee, Guri-si (KR); Paul Joon Sunwoo, Seoul (KR)

(73) Assignee: KT&G Corporation, Daejeon (KR)

( * ) Notice: Subject to any disclaimer, the term of this patent is extended or adjusted under 35 U.S.C. 154(b) by 372 days.

(21) Appl. No.: 18/027,155

(22) PCT Filed: Jan. 19, 2023

(86) PCT No.: PCT/KR2023/000898
§ 371 (c)(1),
(2) Date: Mar. 20, 2023

(87) PCT Pub. No.: WO2023/140627
PCT Pub. Date: Jul. 27, 2023

(65) Prior Publication Data

US 2024/0315340 A1 Sep. 26, 2024

(30) Foreign Application Priority Data

Jan. 19, 2022 (KR) ..... 10-2022-0007584

(51) Int. Cl.
*A24F 40/465* (2020.01)
*A24D 1/20* (2020.01)
(Continued)

(52) U.S. Cl.
CPC ..... *A24F 40/465* (2020.01); *A24D 1/20* (2020.01); *A24F 40/20* (2020.01); *A24F 40/51* (2020.01); *A24F 40/65* (2020.01)

(58) Field of Classification Search
None
See application file for complete search history.

(56) References Cited

U.S. PATENT DOCUMENTS

2017/0095006 A1 4/2017 Egoyants et al.
2020/0163380 A1* 5/2020 Lee ..... A46B 15/0055
(Continued)

FOREIGN PATENT DOCUMENTS

CN 103653258 A 3/2014
CN 106455708 A 2/2017
(Continued)

OTHER PUBLICATIONS

Office Action issued Dec. 15, 2023 in Korean Application No. 10-2022-0007584.
(Continued)

*Primary Examiner* — Cynthia Szewczyk
(74) *Attorney, Agent, or Firm* — Foley & Lardner LLP

(57) ABSTRACT

An aerosol generating device includes a housing, an article insertion portion positioned in the housing, configured to accommodate an aerosol generating article, and including a first end surface, a second end surface opposite to the first end surface, and an inner surface between the first end surface and the second end surface, and a heater module including a heating unit which is positioned in the article insertion portion and heats a medium accommodated in the aerosol generating article, and a deformable unit connected to the heating unit and formed of a material having a property of changing its shape as a temperature changes.

15 Claims, 8 Drawing Sheets

(51) Int. Cl.

| | |
|---|---|
| ***A24F 40/20*** | (2020.01) |
| *A24F 40/51* | (2020.01) |
| *A24F 40/65* | (2020.01) |

(56) References Cited

U.S. PATENT DOCUMENTS

| | | | | |
|---|---|---|---|---|
| 2020/0390157 | A1* | 12/2020 | Hepworth | A61M 15/06 |
| 2021/0052010 | A1* | 2/2021 | Duc | A61M 11/048 |
| 2021/0244096 | A1 | 8/2021 | Van Lancker et al. | |
| 2021/0244100 | A1* | 8/2021 | Van Lancker | A24F 40/42 |

FOREIGN PATENT DOCUMENTS

| | | | |
|---|---|---|---|
| KR | 10-2017-0078844 | A | 7/2017 |
| KR | 10-2019-0111082 | A | 10/2019 |
| KR | 10-2021-0006385 | A | 1/2021 |
| KR | 10-2021-0006385 | A1 | 1/2021 |
| KR | 10-2021-0009347 | A | 1/2021 |
| KR | 10-2021-0016770 | A | 2/2021 |
| KR | 2021-0156639 | A | 12/2021 |
| WO | 2017/068101 | A1 | 4/2017 |
| WO | 2018/190603 | A1 | 10/2018 |
| WO | 2019/030172 | A1 | 2/2019 |

OTHER PUBLICATIONS

International Search Report dated Apr. 26, 2023 issued in International Application No. PCT/KR2023/000898.
Chinese Office Action on CN Patent Appl. No. 202380009713.1 dated Dec. 12, 2025.

* cited by examiner

AEROSOL GENERATING DEVICE AND AEROSOL GENERATING SYSTEM

CROSS REFERENCE TO RELATED APPLICATIONS

This application is a National Stage of International Application No. PCT/KR2023/000898 filed Jan. 19, 2023, claiming priority based on Korean Patent Application No. 10-2022-0007584 filed Jan. 19, 2022.

TECHNICAL FIELD

The following embodiments relate to an aerosol generating device and an aerosol generating system.

BACKGROUND ART

Recently, a demand for alternative articles used to overcome disadvantages of traditional aerosol generating articles has increased. For example, there is a growing demand for aerosol generating devices (e.g., an aerosol generating article type electronic cigarette) that generate aerosols by electrically heating aerosol generating sticks. Accordingly, research on an electrically heated aerosol generating device and an aerosol generating stick (or an aerosol generating article) and an aerosol generating system applied thereto is being actively conducted. For example, Korean Patent Publication No. 10-2017-0078844 discloses a device for heating a smokable material.

DISCLOSURE OF THE INVENTION

Technical Goals

An aspect provides an aerosol generating device and an aerosol generating system, which may include a multi-stage heating structure using a deformable unit to efficiently heat a medium accommodated in an aerosol generating article.

An aspect provides an aerosol generating device and an aerosol generating system in which a shape of a deformable unit is changed by heat generated in a heater and a heated portion of the heater moves.

Technical Solutions

According to an aspect, there is provided an aerosol generating device including a housing, an article insertion portion positioned in the housing, configured to accommodate an aerosol generating article, and including a first end surface, a second end surface opposite to the first end surface, and an inner surface between the first end surface and the second end surface, and a heater module including a heating unit positioned in the article insertion portion and configured to heat a medium accommodated in the aerosol generating article and a deformable unit connected to the heating unit and formed of a material having a property of changing a shape as a temperature changes such that the heating unit heats the medium accommodated in the aerosol generating article while moving between a first position and a second position in a longitudinal direction of the aerosol generating article.

The deformable unit may deform to have a shape that changes between the first shape corresponding to the first position of the heating unit and a second shape corresponding to the second position of the heating unit as heat generated in the heating unit is conducted from the first end of the deformable unit toward the second end.

The deformable unit may deform from the first shape to the second shape as a temperature of the heating unit increases.

The deformable unit may deform from the second shape to the first shape as the temperature of the heating unit increases.

The first shape of the deformable unit may be a shape of a roll, and the second shape may be a released shape that is a shape of the roll unwound.

The first shape of the deformable unit may be a compressed spring shape, and the second shape may be a released spring shape.

The deformable unit may include a first end and a second end opposite to the first end, the first end may be fixed to the heating unit, the second end may be a free end, and at least a region between the first end and the second end may contact the second end surface of the article insertion portion.

The deformable unit may include a first end and a second end opposite to the first end, the first end may be fixed to the heating unit, the second end may be fixed to the second end surface of the article insertion portion, and at least a region between the first end and the second end may be wound.

The heater module may be configured to contact at least a portion of the inner surface of the article insertion portion and enclose at least a portion of an outer circumferential surface of the aerosol generating article when the aerosol generating article is inserted into the article insertion portion.

The heater module may protrude from the second end surface of the article insertion portion such that the heater module is inserted into the aerosol generating article when the aerosol generating article is inserted into the article insertion portion.

The aerosol generating device may further include a support structure contacting the second end surface of the article insertion portion, and the deformable unit may include a first end connected to the heating unit, a second end opposite to the first end, and a support between the first end and the second end, the support contacting the support structure.

The support may vary between the first end and the second end of the deformable unit as a temperature of the heating unit changes.

The deformable unit may be formed of at least one of a shape memory alloy, a shape memory polymer, a shape memory ceramic, and a bimetal.

According to another aspect, an aerosol generating system may include an aerosol generating article and an aerosol generating device including a housing, an article insertion portion positioned in the housing and configured to accommodate the aerosol generating article, and a heater module including a heating unit positioned in the article insertion portion and configured to heat a medium accommodated in the aerosol generating article and a deformable unit connected to the heating unit and having a property of changing a shape as a temperature changes, wherein the article insertion portion may include a first end surface, a second end surface opposite to the first end surface, and an inner surface between the first end surface and the second end surface, and the heating unit may be configured to heat the aerosol generating article while moving between a first position and a second position in a longitudinal direction of the aerosol generating article.

The aerosol generating article may include a medium accommodating portion and a moisturizing agent accommodating portion disposed at an upstream end of the medium accommodating portion and generating an aerosol, the heating unit may heat the aerosol generating article while moving from the second position to the first position, the first position of the heating unit may correspond to a position of the moisturizing agent accommodating portion of the aerosol generating article, and the second position may correspond to a position of the medium accommodating portion of the aerosol generating article.

Effects

According to an embodiment, an aerosol generating device and an aerosol generating system may efficiently heat a medium accommodated in an aerosol generating article by including a multi-stage heating structure using a deformable unit.

According to an embodiment, in an aerosol generating device and an aerosol generating system, a deformable unit may deform by heat generated in a heater, and a heated portion may move.

The effects of an aerosol generating device and an aerosol generating system according to an embodiment are not limited to the above-mentioned effects, and other unmentioned effects may be clearly understood from the following description by one of ordinary skill in the art.

BEST MODE FOR CARRYING OUT THE INVENTION

Figure 1:
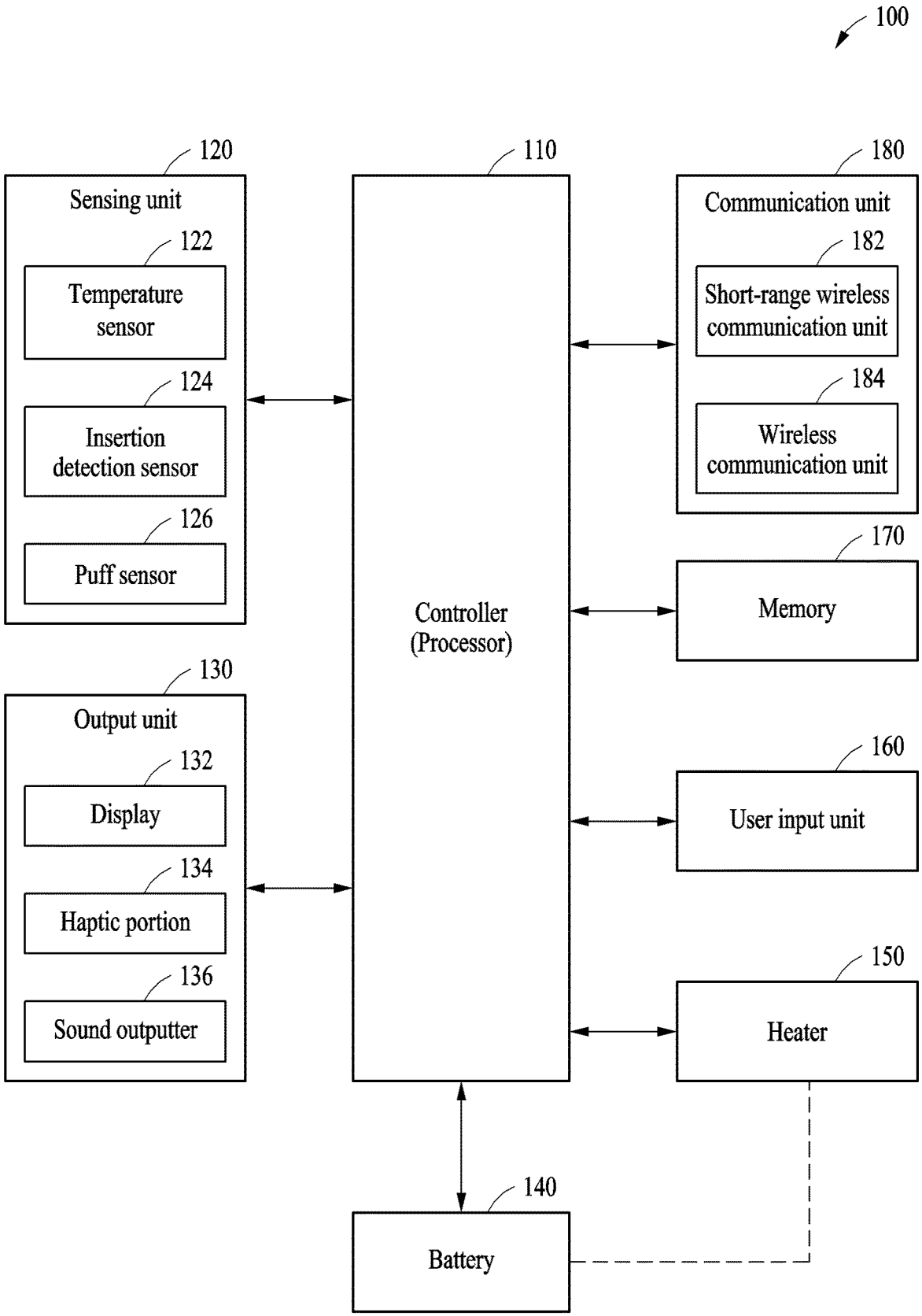
FIG. 1 is a block diagram of an aerosol generating device according to an embodiment.

The terms used to describe the embodiments are selected from among common terms that are currently widely used, in consideration of their function in the disclosure. However, different terms may be used depending on an intention of one of ordinary skill in the art, a precedent, or the advent of new technology. Also, in particular cases, the terms are discretionally selected by the applicant of the disclosure, and the meaning of those terms will be described in detail in the corresponding part of the detailed description. Therefore, the terms used in the disclosure should be defined based on the meanings of the terms and all the content of the disclosure, rather than the terms themselves.

It will be understood that when a certain part "includes" a certain component, the part does not exclude another component but may further include another component, unless the context clearly dictates otherwise. Also, terms such as "unit," "module," etc., as used in the specification may refer to a part for processing at least one function or operation and which may be implemented as hardware, software, or a combination of hardware and software.

As used herein, an expression such as "at least one of" that precedes listed components modifies not each of the listed components but all the listed components. For example, the expression "at least one of a, b, or c" should be construed as including a, b, c, a and b, a and c, b and c, or a, b, and c.

In an embodiment, an aerosol generating device may be a device that generates an aerosol by electrically heating an aerosol generating article accommodated in an inner space.

The aerosol generating device may include a heater. In an embodiment, the heater may be an electrically resistive heater. For example, the heater may include an electrically conductive track, and the heater may be heated as a current flows through the electrically conductive track.

The heater may include a tubular heating element, a plate-shaped heating element, a needle-shaped heating element, or a rod-shaped heating element, and may heat the inside or outside of the aerosol generating article according to the shape of a heating element.

The aerosol generating article may include a tobacco rod and a second segment. The tobacco rod may be formed as a sheet or a strand, or may be formed of tobacco leaves finely cut from a tobacco sheet. Also, the tobacco rod may be surrounded by a thermally conductive material. For example, the thermally conductive material may be a metal foil such as an aluminum foil. However, embodiments are not limited thereto.

The second segment may be a cellulose acetate filter. The second segment may include at least one segment. For example, the second segment may include a first segment that cools an aerosol and a second segment that filters a predetermined ingredient contained in the aerosol.

In another embodiment, the aerosol generating device may be a device that generates an aerosol using a cartridge containing an aerosol generating material.

The aerosol generating device may include a cartridge containing the aerosol generating material and a main body supporting the cartridge. The cartridge may be detachably coupled to the main body. However, embodiments are not limited thereto. The cartridge may be integrally formed or assembled with the main body, and may be secured to the main body so as not to be detached by a user. The cartridge may be mounted on the main body while the aerosol generating material is accommodated therein. However, embodiments are not limited thereto. The aerosol generating material may be injected into the cartridge while the cartridge is coupled to the main body.

The cartridge may hold the aerosol generating material in any one of various states, such as a liquid state, a solid state, a gaseous state, and a gel state. The aerosol generating material may include a liquid composition. For example, the liquid composition may be a liquid including a tobacco-containing material having a volatile tobacco flavor ingredient, or a liquid including a non-tobacco material.

The cartridge may be operated by an electrical signal or a wireless signal transmitted from the main body to perform the function of generating an aerosol by converting the phase of the aerosol generating material inside the cartridge to a gaseous phase. The term "aerosol" may refer to a gas in which vaporized particles generated from the aerosol generating material are mixed with air.

In another embodiment, the aerosol generating device may generate an aerosol by heating the liquid composition, and the generated aerosol may pass through the aerosol generating article and be delivered to the user. That is, the aerosol generated from the liquid composition may travel along airflow paths of the aerosol generating device, and the airflow paths may be configured to allow the aerosol to pass through the aerosol generating article and be delivered to the user.

In another embodiment, the aerosol generating device may be a device that generates an aerosol from the aerosol generating material using an ultrasonic vibration technique. In this case, the ultrasonic vibration technique may be a technique of generating an aerosol by atomizing the aerosol generating material with ultrasonic vibration generated by a vibrator.

The aerosol generating device may include a vibrator, and may generate vibration at short intervals through the vibrator to atomize the aerosol generating material. The vibration generated by the vibrator may be ultrasonic vibration, and a frequency band of the ultrasonic vibration may be from about 100 kilohertz (kHz) to about 3.5 megahertz (MHz). However, embodiments are not limited thereto.

The aerosol generating device may further include a wick that absorbs the aerosol generating material. For example, the wick may be disposed to surround at least one area of the vibrator or may be disposed to contact at least one area of the vibrator.

As a voltage (e.g., an alternating voltage) is applied to the vibrator, the vibrator may generate heat and/or ultrasonic vibration, and the heat and/or ultrasonic vibration generated by the vibrator may be transmitted to the aerosol generating material absorbed in the wick. The aerosol generating material absorbed in the wick may be converted into a gas phase by the heat and/or ultrasonic vibration transmitted from the vibrator, and consequently, an aerosol may be generated.

For example, viscosity of the aerosol generating material absorbed in the wick may be lowered by the heat generated by the vibrator, and the aerosol generating material with lowered viscosity may be changed to fine particles by the ultrasonic vibration generated by the vibrator, and thereby an aerosol may be generated. However, embodiments are not limited thereto.

In another embodiment, the aerosol generating device may be a device that generates an aerosol by heating the aerosol generating article accommodated therein in an induction heating manner.

The aerosol generating device may include a susceptor and a coil. In an embodiment, the coil may apply a magnetic field to the susceptor. As the aerosol generating device supplies power to the coil, a magnetic field may be formed inside the coil. In an embodiment, the susceptor may be a magnetic body that generates heat by an external magnetic field. As the susceptor is positioned inside the coil and generates heat with the magnetic field applied, the aerosol generating article may be heated. Also, optionally, the susceptor may be positioned in the aerosol generating article.

In another embodiment, the aerosol generating device may further include a cradle.

The aerosol generating device and the separate cradle may form a system together. For example, the cradle may be used to charge a battery of the aerosol generating device. Alternatively, a heater may be heated when the cradle and the aerosol generating device are coupled to each other.

Hereinafter, embodiments of the disclosure will be described in detail with reference to the accompanying drawings such that one of ordinary skill in the art may easily practice the disclosure. The disclosure may be practiced in forms that are implementable in the aerosol generating devices according to various embodiments described above or may be embodied and practiced in many different forms and is not limited to the embodiments described herein.

Hereinafter, embodiments of the disclosure will be described in detail with reference to the drawings.

FIG. 1 is a block diagram of an aerosol generating device 100 according to an embodiment.

The aerosol generating device 100 may include a controller 110, a sensing unit 120, an output unit 130, a battery 140, a heater 150, a user input unit 160, a memory 170, and a communication unit 180. However, an internal structure of the aerosol generating device 100 is not limited to what is shown in FIG. 1. It is to be understood by one of ordinary skill in the art to which the disclosure pertains that some of the components shown in FIG. 1 may be omitted or new components may be added according to the design of the aerosol generating device 100.

The sensing unit 120 may sense a state of the aerosol generating device 100 or a state of an environment around the aerosol generating device 100, and transmit sensing information obtained through the sensing to the controller 110. Based on the sensing information, the controller 110 may control the aerosol generating device 100 to control operations of the heater 150, restrict smoking, determine whether an aerosol generating article (e.g., an aerosol generating article, a cartridge, etc.) is inserted, display a notification, and perform other functions.

The sensing unit 120 may include at least one of a temperature sensor 122, an insertion detection sensor 124, or a puff sensor 126. However, embodiments are not limited thereto.

The temperature sensor 122 may sense a temperature at which the heater 150 (or an aerosol generating material) is heated. The aerosol generating device 100 may include a separate temperature sensor for sensing the temperature of the heater 150, or the heater 150 itself may also function as a temperature sensor. Alternatively, the temperature sensor 122 may be arranged around the battery 140 to monitor the temperature of the battery 140.

The insertion detection sensor 124 may sense whether the aerosol generating article is inserted and/or removed. The insertion detection sensor 124 may include, for example, at least one of a film sensor, a pressure sensor, a light sensor, a resistive sensor, a capacitive sensor, an inductive sensor, or an infrared sensor, which may sense a signal change by the insertion and/or removal of the aerosol generating article.

The puff sensor 126 may sense a puff from a user based on various physical changes in an airflow path or airflow channel. For example, the puff sensor 126 may sense the puff from the user based on any one of a temperature change, a flow change, a voltage change, and a pressure change.

The sensing unit 120 may further include at least one of a temperature/humidity sensor, an atmospheric pressure sensor, a magnetic sensor, an acceleration sensor, a gyroscope sensor, a position sensor (e.g., a global positioning system (GPS)), a proximity sensor, or a red, green, blue (RGB) sensor (e.g., an illuminance sensor), in addition to the sensors 122 through 126 described above. A function of a sensor may be intuitively inferred from the name of the sensor by one of ordinary skill in the art, and thus, a more detailed description thereof is not included here.

The output unit 130 may output information about the state of the aerosol generating device 100 and provide the information to the user. The output unit 130 may include at least one of a display 132, a haptic portion 134, or a sound outputter 136. However, embodiments are not limited thereto. When the display 132 and a touchpad are provided in a layered structure to form a touchscreen, the display 132 may be used as an input device in addition to an output device.

The display 132 may visually provide information about the aerosol generating device 100 to the user. The information about the aerosol generating device 100 may include, for example, a charging/discharging state of the battery 140 of the aerosol generating device 100, a preheating state of the heater 150, an insertion/removal state of the aerosol generating article, a limited usage state (e.g., an abnormal article detected) of the aerosol generating device 100, or the like, and the display 132 may externally output the information. The display 132 may be, for example, a liquid-crystal display panel (LCD), an organic light-emitting display panel (OLED), or the like. The display 132 may also be in the form of a light-emitting diode (LED) device.

The haptic portion 134 may provide information about the aerosol generating device 100 to the user in a haptic way by converting an electrical signal into a mechanical stimulus or an electrical stimulus. The haptic portion 134 may include, for example, a motor, a piezoelectric element, or an electrical stimulation device.

The sound outputter 136 may provide information about the aerosol generating device 100 to the user in an auditory way. For example, the sound outputter 136 may convert an electric signal into a sound signal and externally output the sound signal.

The battery 140 may supply power to be used to operate the aerosol generating device 100. The battery 140 may supply power to heat the heater 150. In addition, the battery 140 may supply power required for operations of the other components (e.g., the sensing unit 120, the output unit 130, the user input unit 160, the memory 170, and the communication unit 180) included in the aerosol generating device 100. The battery 140 may be a rechargeable battery or a disposable battery. The battery 140 may be, for example, a lithium polymer (LiPoly) battery. However, embodiments are not limited thereto.

The heater 150 may receive power from the battery 140 to heat the aerosol generating material. Although not shown in FIG. 1, the aerosol generating device 100 may further include a power conversion circuit (e.g., a direct current (DC)-to-DC (DC/DC) converter) that converts power of the battery 140 and supplies the power to the heater 150. In addition, when the aerosol generating device 100 generates an aerosol in an induction heating manner, the aerosol generating device 100 may further include a DC-to-alternating current (AC) (DC/AC) converter that converts DC power of the battery 140 into AC power.

The controller 110, the sensing unit 120, the output unit 130, the user input unit 160, the memory 170, and the communication unit 180 may receive power from the battery 140 to perform functions. Although not shown in FIG. 1, the aerosol generating device 100 may further include a power conversion circuit, for example, a low dropout (LDO) circuit or a voltage regulator circuit, which converts power of the battery 140 and supplies the power to respective components.

In an embodiment, the heater 150 may be formed of a predetermined electrically resistive material that is suitable. The electrically resistive material may be a metal or a metal alloy including, for example, titanium, zirconium, tantalum, platinum, nickel, cobalt, chromium, hafnium, niobium, molybdenum, tungsten, tin, gallium, manganese, iron, copper, stainless steel, nichrome, or the like. However, embodiments are not limited thereto. In addition, the heater 150 may be implemented as a metal heating wire, a metal heating plate on which an electrically conductive track is arranged, a ceramic heating element, or the like, but is not limited thereto.

In another embodiment, the heater 150 may be an induction heater. For example, the heater 150 may include a susceptor that heats the aerosol generating material by generating heat through a magnetic field applied by a coil.

In an embodiment, the heater 150 may include a plurality of heaters. For example, the heater 150 may include a first heater for heating the aerosol generating article and a second heater for heating a liquid.

The user input unit 160 may receive information input from the user or may output information to the user. For example, the user input unit 160 may include a keypad, a dome switch, a touchpad (e.g., a contact capacitive type, a pressure resistive film type, an infrared sensing type, a surface ultrasonic conduction type, an integral tension measurement type, a piezo effect method, etc.), a jog wheel, a jog switch, or the like. However, embodiments are not limited thereto. In addition, although not shown in FIG. 1, the aerosol generating device 100 may further include a connection interface such as a universal serial bus (USB) interface, and may be connected to another external device through the connection interface such as a USB interface to transmit and receive information or to charge the battery 140.

The memory 170, which is hardware for storing various pieces of data processed in the aerosol generating device 100, may store data processed by the controller 110 and data to be processed thereby. The memory 170 may include at least one type of storage medium of a flash memory type memory, a hard disk type memory, a multimedia card micro type memory, a card type memory (e.g., an SD or XE memory), a random access memory (RAM), a static random access memory (SRAM), a read-only memory (ROM), an electrically erasable programmable read-only memory (EEPROM), a programmable read-only memory (PROM), a magnetic memory, a magnetic disk, or an optical disk. The memory 170 may store an operating time of the aerosol generating device 100, a maximum number of puffs, a current number of puffs, at least one temperature profile, data associated with a smoking pattern of the user, or the like.

The communication unit 180 may include at least one component for communicating with another electronic device. For example, the communication unit 180 may include a short-range wireless communication unit 182 and a wireless communication unit 184.

The short-range wireless communication unit 182 may include a Bluetooth communication unit, a BLE communication unit, a near field communication unit, a WLAN (Wi-Fi) communication unit, a ZigBee communication unit, an infrared data association (IrDA) communication unit, a Wi-Fi direct (WFD) communication unit, an ultra-wideband (UWB) communication unit, and an Ant+ communication unit. However, embodiments are not limited thereto.

The wireless communication unit 184 may include, for example, a cellular network communicator, an Internet communicator, a computer network (e.g., a local area network (LAN) or a wide-area network (WAN)) communicator, or the like. However, embodiments are not limited thereto. The wireless communication unit 184 may use subscriber information (e.g., international mobile subscriber identity (IMSI)) to identify and authenticate the aerosol generating device 100 in a communication network.

The controller 110 may control the overall operation of the aerosol generating device 100. In an embodiment, the controller 110 may include at least one processor. The processor may be implemented as an array of a plurality of logic gates, or may be implemented as a combination of a general-purpose microprocessor and a memory in which a program executable by the microprocessor is stored. In addition, it is to be understood by one of ordinary skill in the art to which the disclosure pertains that the processor may be implemented in other types of hardware.

The controller 110 may control the temperature of the heater 150 by controlling supply of power from the battery 140 to the heater 150. For example, the controller 110 may control the supply of power by controlling switching of a switching element between the battery 140 and the heater 150. In another example, a direct heating circuit may control the supply of power to the heater 150 according to a control command from the controller 110.

The controller 110 may analyze a sensing result obtained by the sensing of the sensing unit 120 and control processes to be performed thereafter. For example, the controller 110 may control power to be supplied to the heater 150 to start or end an operation of the heater 150 based on the sensing result obtained by the sensing unit 120. As another example, the controller 110 may control an amount of power to be supplied to the heater 150 and a time for which the power is to be supplied, such that the heater 150 may be heated up to a predetermined temperature or maintained at a desired temperature, based on the sensing result obtained by the sensing unit 120.

The controller 110 may control the output unit 130 based on the sensing result obtained by the sensing unit 120. For example, when the number of puffs counted through the puff sensor 126 reaches a preset number, the controller 110 may inform the user that operation of the aerosol generating device 100 is ending soon, through at least one of the display 132, the haptic portion 134, or the sound outputter 136.

In an embodiment, the controller 110 may control a power supply time and/or a power supply amount for the heater 150 according to a state of the aerosol generating article sensed by the sensing unit 120. For example, when the aerosol generating article is in an over-humidified state, the controller 110 may control the power supply time for an inductive coil to increase a preheating time, compared to a case where the aerosol generating article is in a general state.

An embodiment may also be implemented in the form of a recording medium including instructions executable by a computer, such as a program module executable by the computer. A computer-readable medium may be any available medium that can be accessed by a computer and includes a volatile medium, a non-volatile medium, a removable medium, and a non-removable medium. In addition, the computer-readable medium may include both a computer storage medium and a communication medium. The computer storage medium includes all of a volatile medium, a non-volatile medium, a removable medium, and a non-removable medium implemented by any method or technology for storage of information such as computer-readable instructions, data structures, program modules or other data. The communication medium typically includes computer-readable instructions, data structures, other data in modulated data signals such as program modules, or other transmission mechanisms, and includes any information transfer medium.

Figure 2:
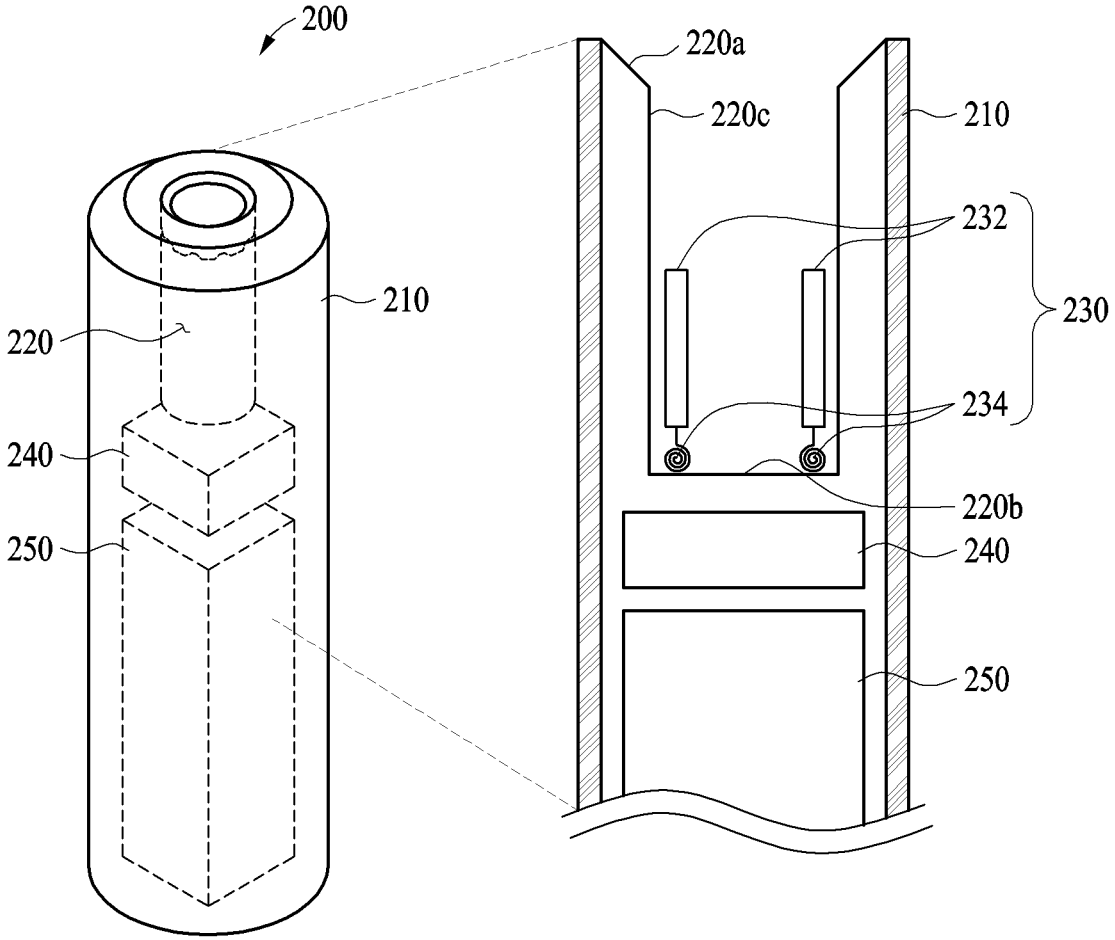
FIG. 2 is a schematic view and a cross-sectional view of an aerosol generating device according to an embodiment.

FIG. 2 is a schematic view and a cross-sectional view of an aerosol generating device according to an embodiment.

According to an embodiment, an aerosol generating device 200 may include a housing 210 configured to accommodate at least a portion of an aerosol generating article and accommodate various electronic/mechanical components.

According to an embodiment, the aerosol generating device 200 may include an article insertion portion 220 configured to accommodate the aerosol generating article. In an embodiment, the article insertion portion 220 may include a first end surface 220*a* (e.g., an upper surface), a second end surface 220*b* (e.g., a lower surface) opposite to the first end surface 220*a*, and an inner surface 220*c* (e.g., a side surface) between the first end surface 220*a* and the second end surface 220*b*. The inner surface 220*c* has a length and a circumference.

According to an embodiment, the aerosol generating device 200 may include a heater module 230 configured to heat at least a portion of the aerosol generating article accommodated in the article insertion portion 220. In an embodiment, the heater module 230 may include a heating unit 232 disposed in the article insertion portion 220 and a deformable unit 234 that is connected to the heating unit 232 and supports the heating unit 232. In an embodiment, the deformable unit 234 may be formed of a material having a property of being able to change shape as a temperature changes.

In an embodiment, the heating unit 232 may be configured to heat a medium accommodated in the aerosol generating article while moving between a first position P1 and a second position P2. The first position P1 may be, for example, a position in which the heating unit 232 is disposed adjacent to the second end surface 220*b* of the article insertion portion 220. The second position P2 may be, for example, a position in which the heating unit 232 is disposed farther from the second end surface 220*b* of the article insertion portion 220, compared to the first position P1.

According to an embodiment, the aerosol generating device 200 may include a controller 240 (e.g., the controller 110) that controls the overall operation of the aerosol generating device 200. The controller 240 may control a temperature of the heating unit 232, for example, by controlling supply of power from a battery 250 to the heater module 230. For example, the controller 240 may control the supply of power by controlling switching of a switching element between the battery 250 and the heater module 230.

According to an embodiment, the aerosol generating device 200 may include the battery 250 (e.g., the battery 140) that supplies power used to operate the aerosol generating device 200. The battery 250 may supply power to heat the heater module 230, for example. The battery 250 may be a rechargeable battery or a disposable battery. The battery 250 may be, for example, a lithium polymer (LiPoly) battery. However, embodiments are not limited thereto.

Hereinafter, an aerosol generating device including a heater module including a deformable unit is described in detail with reference to FIGS. 3A through 5 according to various embodiments.

Figure 3A:
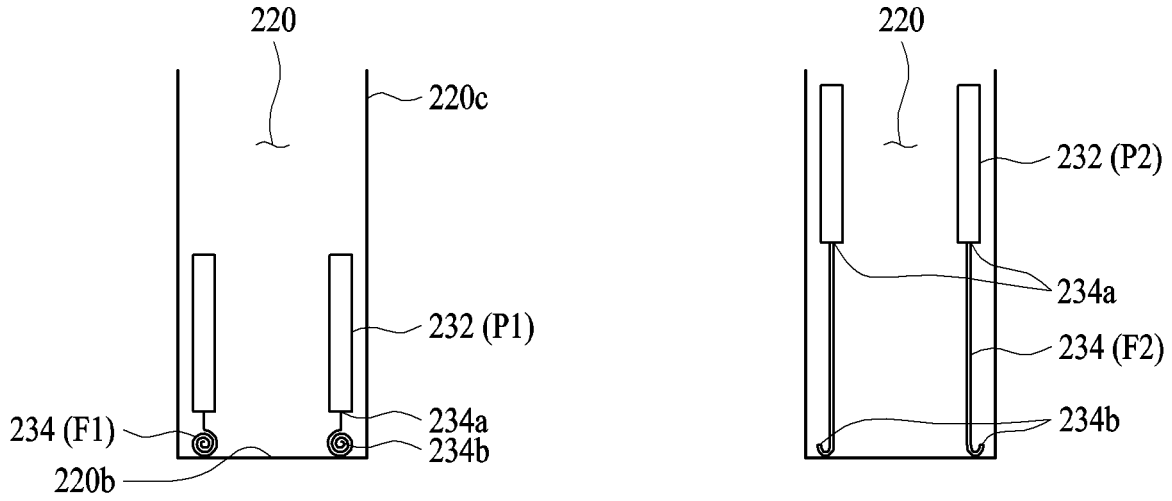
FIGS. 3A and 3B are diagrams illustrating a heater module according to an embodiment.
Figure 3B:
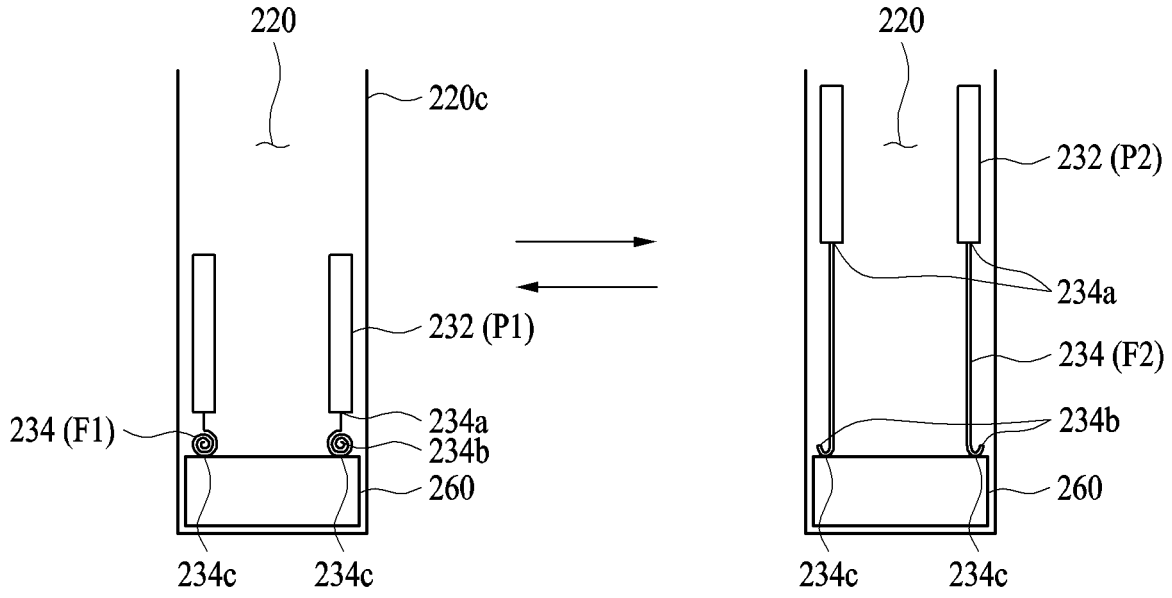

FIGS. 3A and 3B are diagrams illustrating the heater module 230 according to an embodiment.

In an embodiment, the heater module 230 may be included in the article insertion portion 220 (see FIG. 2). The heater module 230 may include the heating unit 232 that substantially generates heat and the deformable unit 234 connected to the heating unit 232.

In an embodiment, the heater module 230 may be configured to contact at least a portion of the inner surface 220*c* of the article insertion portion 220 and may be formed to enclose at least a portion of an outer circumferential surface of the aerosol generating article when an aerosol generating article is inserted into the article insertion portion 220.

In an embodiment, the deformable unit 234 may include a first end 234*a* connected to the heating unit 232 and a second end 234*b* opposite to the first end 234*a*. A shape of the deformable unit 234 may change as heat generated in the heating unit 232 is conducted from the first end 234*a* toward the second end 234*b*. In an embodiment, the deformable unit 234 may have a first shape F1 in which the heating unit 232 is disposed at the first position P1 and a second shape F2 in which the heating unit 232 is disposed at the second position P2, and the deformable unit 234 may change between the first shape F1 and the second shape F2.

In an embodiment, the deformable unit 234 may have a property of changing its shape according to a temperature. For example, the deformable unit 234 may be formed of at least one of a shape memory alloy, a shape memory polymer, a shape memory ceramic, and a bimetal. However, embodiments are not limited thereto.

In an embodiment, the deformable unit 234 may change from the first shape F1 to the second shape F2 (from the shape in the drawing on the left to the shape in the drawing on the right in FIG. 3A) when heat of the heating unit 232 is conducted from the first end 234*a* toward the second end 234*b*. Accordingly, the heating unit 232 may move from the first position P1 to the second position P2. In another embodiment, the deformable unit 234 may change from the second shape F2 to the first shape F1 (from the shape in the drawing on the right to the shape in the drawing on the left in FIG. 3A) when heat is conducted from the first end 234*a* toward the second end 234*b*. In this case, the heating unit 232 may move from the second position P2 to the first position P1.

In an embodiment, as the heating unit 232 moves from the first position P1 to the second position P2, a medium accommodated in an upstream side of the aerosol generating article may start being heated first and a medium accommodated in a downstream side may start being heated next. Accordingly, an amount of burnt odor or an amount of burnt flavor delivered to a user may be reduced or eliminated.

In another embodiment, when the heating unit 232 moves from the second position P2 to the first position P1, the medium accommodated in the downstream side may start being heated first and the medium accommodated in the upstream side may start being heated next. Accordingly, an aerosol may be quickly transferred as a distance between a heated medium and a mouth of the user is relatively short.

Referring to FIG. 3A, the first end 234*a* of the deformable unit 234 may be fixed to the heating unit 232, and the second end 234*b* may be a free end. At least a region between the first end 234*a* and the second end 234*b* of the deformable unit 234 may contact a second end surface 220*b* of the article insertion portion 220. That is, in an embodiment, the first shape F1 of the deformable unit 234 may be a shape of a roll wound on a plane, and the second shape F2 of the deformable unit 234 may be a released shape that is a shape of the roll unwound.

Referring to FIG. 3B, the aerosol generating device 200 may further include a support structure 260 that contacts the second end surface 220*b* of the article insertion portion 220. According to an embodiment, the support structure 260 may support the heater module 230 such that a position of a medium accommodating portion of the aerosol generating article matches a position of the heating unit 232. In an embodiment, the deformable unit 234 may include the first end 234*a*, the second end 234*b* formed on an opposite side of the first end 234*a*, a support 234*c* between the first end 234*a* and the second end 234*b*, the support contacting the support structure 260. According to an embodiment, as the shape of the deformable unit 234 changes, a position of the support 234*c* may change between the first end 234*a* and the second end 234*b*.

Figure 4:
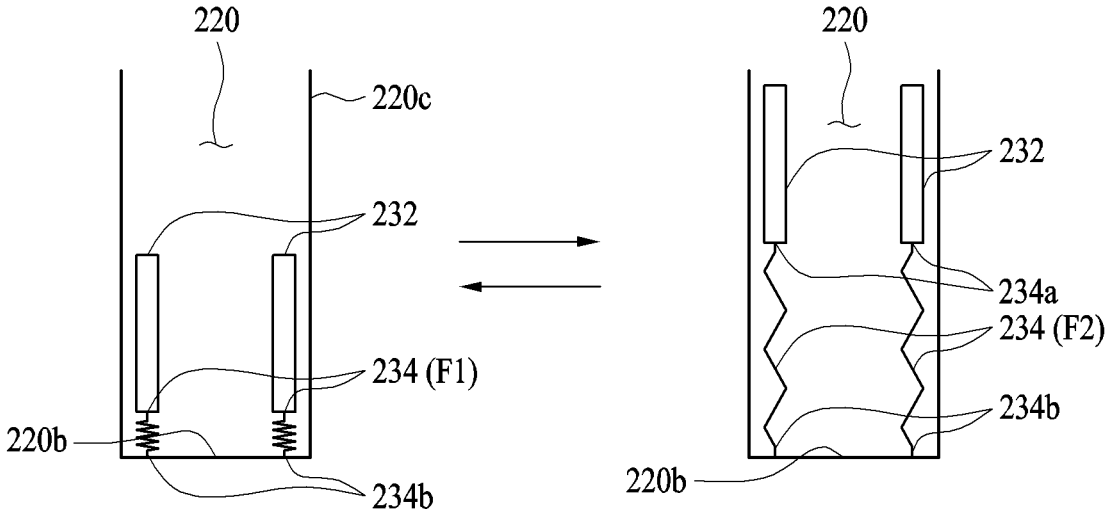
FIG. 4 is a diagram illustrating a heater module according to another embodiment.

FIG. 4 is a diagram illustrating the heater module 230 according to an embodiment.

According to another embodiment, the heater module 230 may include the heating unit 232 that substantially generates heat and the deformable unit 234 connected to the heating unit 232.

Referring again to FIG. 4, the deformable unit 234 may include the first end 234*a* and the second end 234*b* opposite to the first end 234*a*. The first end 234*a* of the deformable unit 234 may be fixed to the heating unit 232, and the second end 234*b* may be fixed to the second end surface 220*b* of the article insertion portion 220 or a support structure (e.g., the support structure 260 of FIG. 3B). At least a region between the first end 234*a* and the second end 234*b* may be a winding shape (i.e., non-linear shape) and include a zigzag type, a spring type, and/or a roll type. That is, in an embodiment, the first shape F1 of the deformable unit 234 may be a compressed spring shape, and the second shape F2 of the deformable unit 234 may be a released spring shape.

Figure 5:
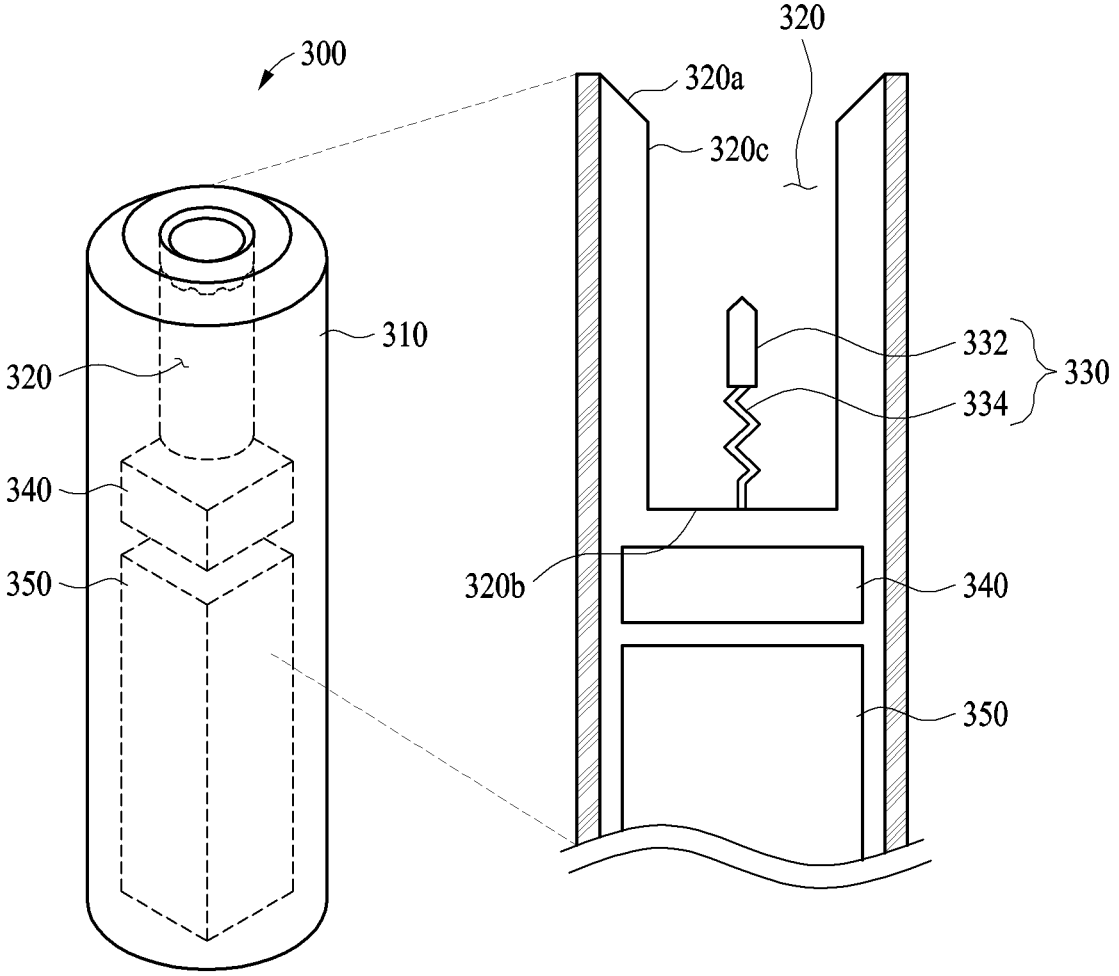
FIG. 5 is a schematic view and a cross-sectional view of an aerosol generating device according to another embodiment.

FIG. 5 is a schematic view and a cross-sectional view of an aerosol generating device 300 according to another embodiment.

According to another embodiment, the aerosol generating device 300 may include a housing 310, an article insertion portion 320, a heater module 330, a controller 340, and a battery 350.

In another embodiment, the housing 310, the article insertion portion 320, the controller 340, and the battery 350 may be identical or similar to the housing 210, the article insertion portion 220, the controller 240, and the battery 250 of the aerosol generating device 200 according to an embodiment, respectively.

Hereinafter, the heater module 330 of the aerosol generating device 300 according to another embodiment that is different from that of the aerosol generating device 200 according to an embodiment is described in detail.

Referring to FIG. 5, the heater module 330 may include a heating unit 332 configured to be disposed in the article insertion portion 220 and a deformable unit 334 that is connected to the heating unit 332 and supports the heating unit 332. In an embodiment, the deformable unit 334 may be formed of a material having a property of changing its shape as a temperature changes.

Referring again to FIG. 5, the heating unit 332 and the deformable unit 334 of the heater module 330 may protrude from a second end surface 320*b* of the article insertion portion 320 in a longitudinal direction toward the first end surface 320*a*. For example, the heater module 330 may be provided in a pin form, a blade form, and/or a needle form. When the heater module 330 is provided in the pin form, the blade form, and/or the needle form and an aerosol generating article is inserted into the article insertion portion 320, the heater module 330 may be easily inserted into the aerosol generating article and may heat a medium accommodated in the aerosol generating article.

Hereinafter, an aerosol generating system 10 is described in detail with reference to FIGS. 6 through 7B.

Figure 6:
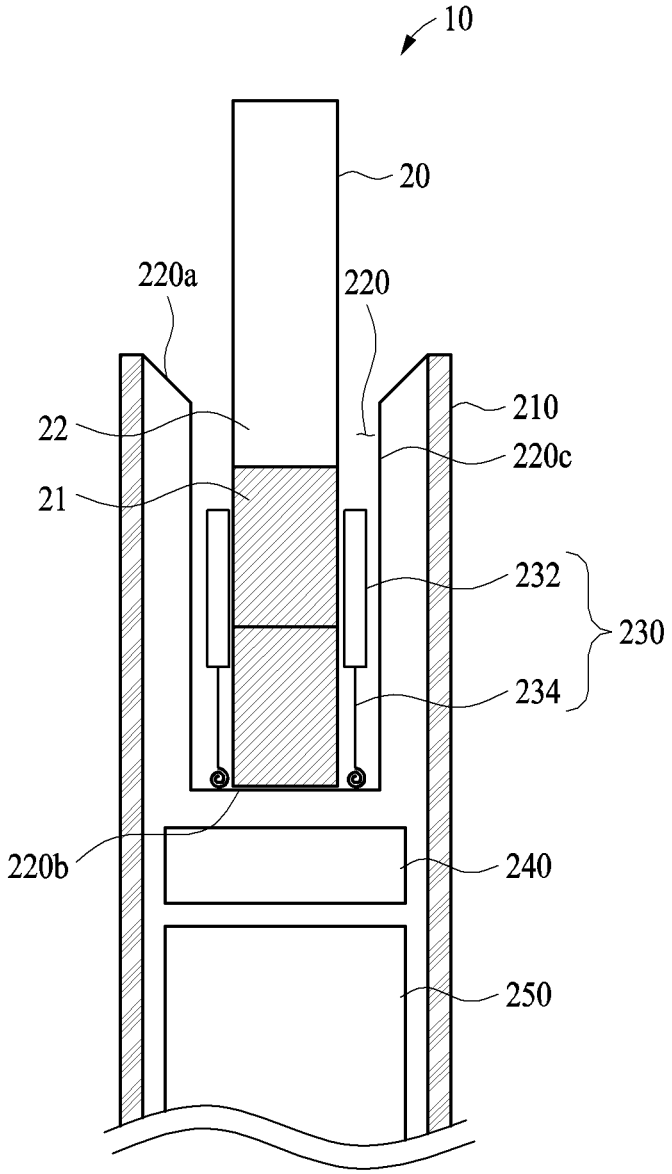
FIG. 6 is a cross-sectional view of an aerosol generating system according to an embodiment.

FIG. 6 is a cross-sectional view of the aerosol generating system 10 according to an embodiment.

According to an embodiment, the aerosol generating system 10 may include an aerosol generating article 20 and the aerosol generating device 200.

According to an embodiment, the aerosol generating article 20 may include a first segment 21 and a second segment 22. According to an embodiment, the first segment 21 may be a segment that accommodates a medium, a moisturizing agent, a flavoring agent, and/or an aerosol-forming substrate. According to an embodiment, the second segment 22 may include a segment that cools an aerosol and a segment that filters a predetermined ingredient contained in the aerosol. The first segment 21 and the second segment 22 may have a single segment as illustrated in FIG. 6. However, embodiments are not limited thereto and may include a plurality of segments.

According to an embodiment, the aerosol generating device 200 may include the housing 210, the article insertion portion 220, the heater module 230, the controller 240, and the battery 250.

According to an embodiment, the heater module 230 may include the heating unit 232 that heats the aerosol generating article 20 and the deformable unit 234 that is connected to the heating unit 232 and supports the heating unit 232. According to an embodiment, the deformable unit 234 may have a property of changing its shape as a temperature changes. The heating unit 232 may generate heat while moving along an outer surface of the first segment 21 of the aerosol generating article 20 in a longitudinal direction between a first position (e.g., P1 of FIG. 3A) and a second position (e.g., P2 of FIG. 3A) according to a change in shape of the deformable unit 234.

Figure 7A:
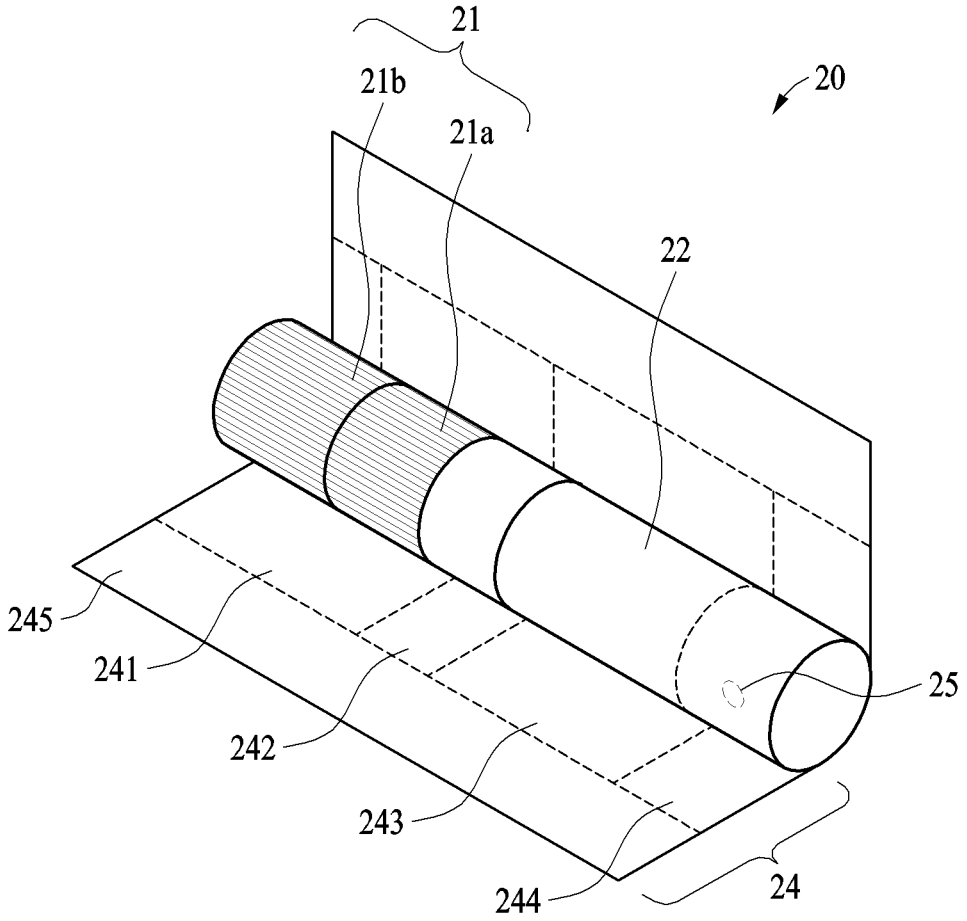
FIGS. 7A and 7B are diagrams illustrating an aerosol generating article according to an embodiment.
Figure 7B:
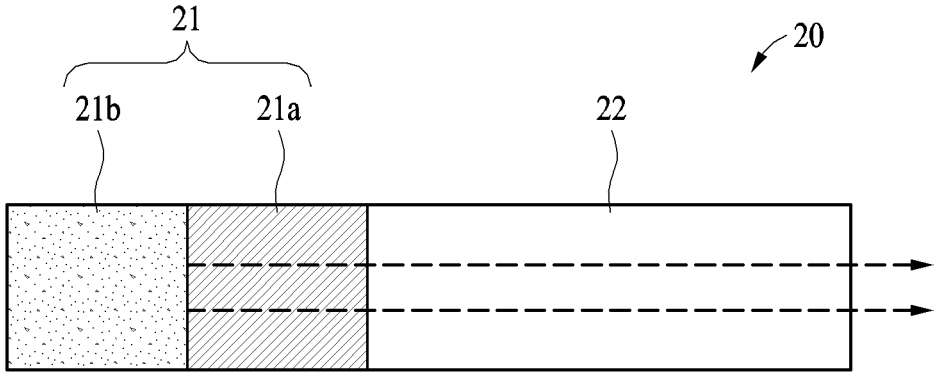

FIGS. 7A and 7B are diagrams illustrating the aerosol generating article 20 according to an embodiment.

Referring to FIG. 7A, the aerosol generating article 20 may be wrapped with at least one wrapper 24. The wrapper 24 may have at least one hole through which external air is introduced or internal gas flows out. As an example, the aerosol generating article 2 may be wrapped with one wrapper 24. As another example, the aerosol generating article 2 may be wrapped with two or more of wrappers 24 in an overlapping manner. For example, the first segment 21 may be wrapped with a first wrapper 241, and the second segment 22 may be wrapped with wrappers 242, 243, and 244. In addition, the aerosol generating article 2 may be entirely wrapped again with a single wrapper 245. If the second segment 22 includes a plurality of segments, the segments may be wrapped with the wrappers 242, 243, and 244, respectively.

Referring again to FIG. 7A, the first wrapper 241 and the second wrapper 242 may be formed of general filter wrapping paper. For example, the first wrapper 241 and the second wrapper 242 may be porous wrapping paper or non-porous wrapping paper. In addition, the first wrapper 241 and the second wrapper 242 may be formed of oilproof paper and/or an aluminum laminated wrapping material. The third wrapper 243 may be formed of hard wrapping paper, the fourth wrapper 244 may be formed of oilproof hard wrapping paper, and the fifth wrapper 245 may be formed of sterile paper (e.g., MFW).

The second segment 22 may be a cellulose acetate filter. However, a shape of the second segment 22 is not limited. For example, the second segment 22 may be a cylindrical rod or a tubular rod including a hollow therein. The second segment 22 may also be a recess-type rod. For example, when the second segment 22 includes a plurality of segments, at least one of the segments may be manufactured in a different shape.

Referring again to FIG. 7A, the second segment 22 may include at least one capsule 25. The capsule 25 may perform a function of generating a flavor or a function of generating an aerosol. For example, the capsule 25 may have a structure in which a liquid containing a fragrance is wrapped with a film. The capsule 25 may have a spherical or cylindrical shape. However, embodiments are not limited thereto.

Referring to FIGS. 7A and 7B, the first segment 21 may include a medium segment 21*a* and an atomization segment 21*b*. According to an embodiment, the medium segment 21*a* may include a medium. For example, the medium may include solid materials based on tobacco raw materials such as tobacco sheets, cut tobacco leaves, and reconstituted tobacco and a liquid composition based on nicotine, a tobacco extract, and/or various fragrances. However, embodiments are not limited thereto. According to an embodiment, the atomization segment 21*b* may include an aerosol generating material. The aerosol generating material may include, for example, at least one of glycerin, propylene glycol, ethylene glycol, dipropylene glycol, diethylene glycol, triethylene glycol, tetraethylene glycol, or oleyl alcohol. However, embodiments are not limited thereto. The medium segment 21 may also include other additives such as a flavoring agent, a wetting agent, and/or organic acid. In addition, a flavoring liquid such as menthol or a moisturizing agent may be added as being sprayed onto the medium segment 21.

The atomization segment 21*b* may be disposed at an upstream end of the medium segment 21*a*. As the atomization segment 21*b* is heated, an aerosol may be generated by the aerosol generating material included in the atomization segment, and the generated aerosol may pass through the medium segment 21*a* and be transferred to a mouth of a user. The generated aerosol may transfer the medium accommodated in the medium segment 21*a* together.

In an embodiment, when the aerosol generating article 20 including the medium segment 21*a* and the atomization segment 21*b* is accommodated in the aerosol generating device 200 (see FIG. 6), the heating unit 232 may heat the aerosol generating article 20 while moving between the second position P2 (e.g., the right portion of FIG. 3A) corresponding to a position of the medium segment 21*a* and the first position P1 (e.g., the left portion of FIG. 3A) corresponding to a position of the atomization segment 21*b*. In an embodiment, the heating unit 232 may heat the aerosol generating article 20 while moving from the second position P2 to the first position P1. When the heating unit 232 heats the aerosol generating article 20 while moving from the second position P2 to the first position P1, it may be possible to generate atomization more amply by preheating the medium segment 21*a* and then heating the atomization segment 21*b*.

While the embodiments are described with reference to drawings, it will be apparent to one of ordinary skill in the art that various alterations and modifications in form and details may be made to these embodiments without departing from the spirit and scope of the claims and their equivalents. For example, suitable results may be achieved if the described techniques are performed in a different order and/or if components in a described system, architecture, device, or circuit are combined in a different manner and/or replaced or supplemented by other components or their equivalents.

Therefore, other implementations, other embodiments, and equivalents of the claims are within the scope of the following claims.

The invention claimed is:

1. An aerosol generating device comprising:

a housing;

an article insertion portion positioned in the housing, configured to accommodate an aerosol generating article, and comprising a first end surface, a second end surface opposite to the first end surface, and an inner surface between the first end surface and the second end surface; and a heater module comprising a heating unit positioned in the article insertion portion and configured to heat a medium accommodated in the aerosol generating article, and a deformable unit connected to the heating unit and configured to deform as a temperature changes such that the heating unit heats the medium accommodated in the aerosol generating article while moving between a first position of the heating unit and a second position of the heating unit in a longitudinal direction of the aerosol generating article, wherein the heating unit is configured to heat a first portion of the medium in a first position of the article insertion portion and to be moved to a second position of the article insertion portion and heat a second portion of the medium different from the first portion of the medium.

2. The aerosol generating device of claim 1, wherein the deformable unit comprises a first end and a second end opposite to the first end, and the deformable unit is configured to deform to change between a first shape according to the first position of the heating unit and a second shape according to the second position of the heating unit as heat generated in the heating unit is conducted from the first end toward the second end of the deformable unit.

3. The aerosol generating device of claim 2, wherein the deformable unit is configured to deform from the first shape to the second shape as heat is conducted from the heating unit to the deformable unit.

4. The aerosol generating device of claim 2, wherein the deformable unit is configured to deform from the second shape to the first shape as heat is conducted from the heating unit to the deformable unit.

5. The aerosol generating device of claim 2, wherein the first shape of the deformable unit is a shape of a roll, and the second shape is a released shape that is a shape of the roll unwound.

6. The aerosol generating device of claim 2, wherein the first shape of the deformable unit is a compressed spring shape, and the second shape of the deformable unit is a released spring shape.

7. The aerosol generating device of claim 1, wherein the deformable unit comprises a first end and a second end opposite to the first end, and the first end is fixed to the heating unit, the second end is a free end, and at least a region between the first end and the second end contacts the second end surface of the article insertion portion.

8. The aerosol generating device of claim 1, wherein the deformable unit comprises a first end and a second end opposite to the first end, and the first end is fixed to the heating unit, the second end is fixed to the second end surface of the article insertion portion, and at least a region between the first end and the second end is non-linear.

9. The aerosol generating device of claim 1, wherein the heater module is configured to contact at least a portion of the inner surface of the article insertion portion and enclose at least a portion of an outer circumferential surface of the aerosol generating article when the aerosol generating article is inserted into the article insertion portion.

10. The aerosol generating device of claim 1, wherein the heater module protrudes from the second end surface of the article insertion portion such that the heater module is inserted into the aerosol generating article when the aerosol generating article is inserted into the article insertion portion.

11. The aerosol generating device of claim 1, further comprising:

a support structure contacting the second end surface of the article insertion portion, wherein the deformable unit comprises a first end connected to the heating unit, a second end opposite to the first end, and a support between the first end and the second end, the support contacting the support structure.

12. The aerosol generating device of claim 11, wherein a position of the support varies between the first end and the second end of the deformable unit as the deformation unit deforms.

13. The aerosol generating device of claim 1, wherein the deformable unit is formed of at least one of a shape memory alloy, a shape memory polymer, a shape memory ceramic, and a bimetal.

14. An aerosol generating system comprising:

an aerosol generating article; and an aerosol generating device comprising a housing, an article insertion portion positioned in the housing and configured to accommodate the aerosol generating article, and a heater module comprising a heating unit positioned in the article insertion portion and configured to heat a medium accommodated in the aerosol generating article and a deformable unit connected to the heating unit and formed of a material having a property of changing a shape as a temperature changes, wherein the article insertion portion comprises a first end surface, a second end surface opposite to the first end surface, and an inner surface between the first end surface and the second end surface, and wherein the heating unit is configured to heat the aerosol generating article while moving between a first position of the heating unit and a second position of the heating unit in a longitudinal direction of the aerosol generating article, wherein the heating unit is configured to heat a first portion of the medium in a first position of the article insertion portion and to be moved to a second position of the article insertion portion and heat a second portion of the medium different from the first portion of the medium.

15. The aerosol generating system of claim 14, wherein the aerosol generating article comprises:

a medium segment; and an atomization segment disposed at an upstream end of the medium segment and configured to generate an aerosol, the heating unit is configured to heat the aerosol generating article while moving from the second position of the heating unit to the first position of the heating unit, and the first position of the heating unit corresponds to a position of the atomization segment of the aerosol generating article, and the second position of the heating unit corresponds to a position of the medium segment of the aerosol generating article.

* * * * *